US011767617B2

(12) United States Patent
Young et al.

(10) Patent No.: US 11,767,617 B2
(45) **Date of Patent: *Sep. 26, 2023**

(54) ARTICLE OF MANUFACTURE MAKING SYSTEM

(71) Applicant: The Procter & Gamble Company, Cincinnati, OH (US)

(72) Inventors: Christopher Michael Young, Loveland, OH (US); Steven Lee Barnholtz, West Chester, OH (US); Fei Wang, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 34 days.

This patent is subject to a terminal disclaimer.

(21) Appl. No.: 17/541,688

(22) Filed: Dec. 3, 2021

(65) Prior Publication Data

US 2022/0090323 A1 Mar. 24, 2022

Related U.S. Application Data

(63) Continuation of application No. 16/511,428, filed on Jul. 15, 2019, now Pat. No. 11,220,789, which is a (Continued)

(51) Int. Cl.

| | |
|---|---|
| ***D01G 13/00*** | (2006.01) |
| ***D04H 1/732*** | (2012.01) |
| ***D01G 1/02*** | (2006.01) |
| *D21H 27/00* | (2006.01) |
| *D04H 1/407* | (2012.01) |

(52) U.S. Cl.

CPC ..... *D01G 13/00* (2013.01); *D01G 1/02* (2013.01); *D04H 1/732* (2013.01); *D04H 1/407* (2013.01); *D21H 27/002* (2013.01)

(58) Field of Classification Search

CPC ..... D04H 1/407; D04H 1/732; A61F 2013/15943; D01G 1/02; D01G 13/00; D21H 27/002

See application file for complete search history.

(56) References Cited

U.S. PATENT DOCUMENTS

| | | | |
|---|---|---|---|
| 2,641,028 | A | 6/1953 | Harmon |
| 2,845,661 | A | 8/1958 | Erik et al. |

(Continued)

FOREIGN PATENT DOCUMENTS

| | | | |
|---|---|---|---|
| DE | 1122823 | B | 1/1962 |
| GB | 1224325 | A | 3/1971 |

(Continued)

OTHER PUBLICATIONS

All Office Actions, U.S. Appl. No. 13/889,415.

(Continued)

*Primary Examiner* — Shaun R Hurley

(74) *Attorney, Agent, or Firm* — C. Brant Cook; James E. Oehlenschlager

(57) ABSTRACT

An article of manufacture making system for making an article of manufacture containing a plurality of dry solid additives, such as fibers, that utilizes a dry solid additive delivery system with a relatively low Stokes Number for the dry solid additives.

18 Claims, 10 Drawing Sheets

Related U.S. Application Data continuation of application No. 15/172,174, filed on Jun. 3, 2016, now Pat. No. 10,378,133.

(60) Provisional application No. 62/170,172, filed on Jun. 3, 2015.

(56) References Cited

U.S. PATENT DOCUMENTS

| | | | | |
|---|---|---|---|---|
| 3,030,245 | A | 4/1962 | Greiner et al. | |
| 3,509,604 | A | 5/1970 | Furbeck | |
| 3,812,553 | A | 5/1974 | Marshall et al. | |
| 3,862,867 | A | 1/1975 | Marshall | |
| 4,060,360 | A | 11/1977 | Tapp | |
| 4,366,111 | A | 12/1982 | Dinius et al. | |
| 4,741,941 | A | 5/1988 | Englebert | |
| 4,970,104 | A | 11/1990 | Radwanski | |
| 5,306,453 | A | 4/1994 | Shulman | |
| 5,580,423 | A | 12/1996 | Ampulski | |
| 5,725,927 | A | 3/1998 | Zilg | |
| 5,962,112 | A | 10/1999 | Haynes | |
| 6,233,787 | B1 | 5/2001 | Eriksen | |
| 7,972,986 | B2 | 7/2011 | Barnholtz et al. | |
| 8,122,570 | B2 | 2/2012 | Jezzi | |
| 8,758,569 | B2 | 6/2014 | Aberg et al. | |
| 9,103,057 | B2 | 8/2015 | Polosa et al. | |
| 9,458,573 | B2 | 10/2016 | Barnholtz et al. | |
| 11,220,789 | B2 * | 1/2022 | Young | D04H 1/732 |
| 2003/0116888 | A1 * | 6/2003 | Rymer | D04H 1/54 264/460 |
| 2003/0200991 | A1 | 10/2003 | Keck | |
| 2003/0211802 | A1 | 11/2003 | Keck et al. | |
| 2004/0155383 | A1 | 8/2004 | Jackson et al. | |
| 2005/0247416 | A1 | 11/2005 | Forry et al. | |
| 2007/0228064 | A1 | 10/2007 | Brennan et al. | |
| 2009/0241831 | A1 | 10/2009 | Jezzi | |
| 2010/0209308 | A1 | 8/2010 | Kunze et al. | |
| 2010/0297378 | A1 | 11/2010 | Mellin et al. | |
| 2011/0039054 | A1 | 2/2011 | Cabell et al. | |
| 2011/0039469 | A1 | 2/2011 | Cabell et al. | |
| 2011/0061214 | A1 | 3/2011 | Wirtz et al. | |
| 2011/0104970 | A1 | 5/2011 | Barnholtz et al. | |
| 2011/0244199 | A1 | 10/2011 | Brennan et al. | |
| 2011/0247839 | A1 | 10/2011 | Lalouch et al. | |
| 2011/0250378 | A1 | 10/2011 | Eaton et al. | |
| 2013/0071624 | A1 | 3/2013 | Manifold et al. | |
| 2013/0167305 | A1 | 7/2013 | Weisman et al. | |
| 2013/0216789 | A1 | 8/2013 | Kraus et al. | |
| 2013/0302566 | A1 | 11/2013 | Barnholtz et al. | |
| 2014/0179586 | A1 | 6/2014 | Letzelter et al. | |
| 2014/0308486 | A1 | 10/2014 | Butsch et al. | |
| 2014/0308518 | A1 | 10/2014 | Gordon et al. | |
| 2014/0323381 | A1 | 10/2014 | Hatzelt et al. | |
| 2014/0331456 | A1 | 11/2014 | Wu et al. | |
| 2015/0086659 | A1 | 3/2015 | Klofta et al. | |
| 2016/0355959 | A1 | 12/2016 | Young et al. | |
| 2016/0355960 | A1 | 12/2016 | Young et al. | |
| 2019/0338449 | A1 | 11/2019 | Young et al. | |
| 2019/0338468 | A1 * | 11/2019 | Young | D21H 27/002 |

FOREIGN PATENT DOCUMENTS

| | | | |
|---|---|---|---|
| WO | 2011156300 | A1 | 12/2011 |
| WO | 2012006338 | A2 | 1/2012 |
| WO | 2015150054 | A1 | 10/2015 |
| WO | 2016078913 | A1 | 5/2016 |

OTHER PUBLICATIONS

All Office Actions, U.S. Appl. No. 15/172,271.
All Office Actions, U.S. Appl. No. 15/172,172.
All Office Actions, U.S. Appl. No. 15/172,174.
All Office Actions, U.S. Appl. No. 15/243,140.
All Office Actions; U.S. Appl. No. 16/511,428, filed Jul. 15, 2019.
International Search Report and Written Opinion; Application Ser. No. PCT/US2016/035386; dated Aug. 3, 2016, 9 pages.

* cited by examiner

ARTICLE OF MANUFACTURE MAKING SYSTEM

FIELD OF THE INVENTION

The present invention relates to an article of manufacture making system, more particularly to an article of manufacture making system for making an article of manufacture comprising a plurality of dry solid additives, such as fibers, and even more particularly to an article of manufacture making system comprising a dry solid additive delivery system for making an article of manufacture comprising a plurality of dry solid additives, such as fibers.

BACKGROUND OF THE INVENTION

To date, processes in which a non-liquid fluid, such as air, is used to convey dry solid additives, such as fibers, for example pulp fibers, for the forming of an article of manufacture, for example a fibrous structure, such as a sanitary tissue product, comprising the pulp fibers, have suffered from a contradiction of high throughput, mechanical complexity, and individualization quality of the dry solid additives, for example lack of agglomerations of the dry solid additives. Existing dry solid additive delivery systems have been designed as a series of unit operations that, while serving their purpose, are not arranged in a holistic manner to address the key transformations required to form a high quality fibrous structure. The present invention describes novel ways to address these contradictions.

The low density and viscosity of typically used non-liquid fluids, such as air (especially when compared with water, another key conveying fluid for the formation of fibrous structures comprising solid additives) have resulted in dry solid additive systems with high mechanical complexity and relatively low throughputs when compared to liquid/wet solid additive delivery systems as used in wet laid papermaking processes. Examples of such mechanically complex dry solid additive delivery systems are shown in Prior Art FIGS. 1A, 1B, 1C, and 1D. These dry solid additive delivery systems show contraptions which aid in the redistribution of dry solid additives introduced to them. These dry solid additive delivery systems are typically fed via a prime mover such as a centrifugal fan. As such, the discharge of the fan is typically round in cross section and thus exhibits an aspect ratio of 1. In order to spread the dry solid additives across a wide length for the forming of fibrous structures, a corrective action, such as a pinned roller or some other method of air and particle redistribution must take place.

Prior Art FIG. 1A illustrates an example of an existing dry solid additive delivery system for delivering individualized dry solid additives. The system comprises a round to square (or high aspect ratio) diffuser. The dry solid additive delivery system is plagued with mechanical complexity by requiring a plurality of rotors, which are cross flow members that rotate during operation to mitigate clumping and/or agglomerating of the dry solid additives passing through the dry solid additive delivery system.

Prior Art FIG. 1B illustrates an example of an existing dry solid additive delivery system in which individualized fibers are fed into a rotating device above a screen, which are both cross flow members. This dry solid additive delivery system still exhibits mechanical complexity as mechanical air foils are used to assist dry solid additives in passing through the system and to prevent the screen from clogging by the dry solid additives.

Prior Art FIG. 1C illustrates an example of an existing dry solid additive delivery system for delivery of individualized dry solid additives. The system utilizes rotating cylinders, which are cross flow members that comprise slot openings to permit the individualized dry solid additives to pass through. The individualized dry solid additives enter into the end of cylinders whose axis of rotation is perpendicular to the direction of a fibrous structure being made from the dry solid additives. The cylinders rotate during operation to mitigate clumping and/or agglomerating of the dry solid additives passing through the dry solid additive delivery system.

Prior Art FIG. 1D illustrates an example of an existing dry solid additive delivery system for delivery of individualized dry solid additives. The system utilizes a plurality of pinned rolls, which are cross flow members, and introduces the individualized dry solid additives in a perpendicular fashion into a large volume containing a myriad of the pinned rolls. The pinned rolls are rotating during operation to mitigate clumping and/or agglomerating of the dry solid additives passing through the dry solid additive delivery system.

The mechanical complexities of the prior art dry solid additive delivery systems described above create various issues that need to be overcome, such as reliability issues, contamination issues, decreased throughput issues and the like.

FIG. 1E illustrates an example of an existing dry solid additive delivery system for delivery of individualized dry solid additives. This system is mechanically simpler than the previous prior art examples shown in Prior Art FIGS. 1A-1D, no cross flow members like those described above, but it too suffers from the previously noted contradiction. The design of its discretizer that supplies the dry solid additives to the system requires that a high pressure air source (a prime mover) impinge upon teeth of its screenless discretizer. In this instance, the source of kinetic energy in the system is that high pressure air source, which serves to propel the subsequently individualized dry solid additives forward in the system. Its prime mover is positioned at the same position in the dry solid additive delivery system as its dry solid additive source (discretizer). This screenless discretizer prevents the dry solid additives from being fully individualized, resulting in poor formation upon forming a fibrous structure.

One problem with existing dry solid additive delivery systems, especially those used in article of manufacture making systems used to make articles of manufacture comprising such dry solid additives rather than dry solid additive delivery systems used merely to transport dry solid additives, such as is used in the cement industry and coal burning industries, is that the existing dry solid additive delivery systems exhibit reliability, contamination, and/or formation issues due to their mechanical complexity and/or formation issues due to their positioning of their dry solid additive source and their prime mover at the same position within the system.

Accordingly, there is a need for an article of manufacture making system comprising a dry solid additive delivery system that mitigates and/or eliminates the problems associated with known dry solid additive delivery systems.

SUMMARY OF THE INVENTION

The present invention fulfills the needs described above by providing an article of manufacture making system for making an article of manufacture comprising a plurality of dry solid additives, wherein the article of manufacture making system comprises an improved dry solid additive delivery system that minimizes the Stokes Number of the dry solid additives within the dry solid additive delivery system compared to known dry solid additive delivery systems used in known article of manufacture making systems.

One solution to the problem identified above is to provide an article of manufacture making system used to make articles of manufacture comprising dry solid additives that exhibits improved reliability, less tendency for contamination from broken or chipped components within the system, such as pins, rotors, etc., and/or improved formation of the article of manufacture, for example fibrous structure comprising the dry solid additives by exhibiting less mechanical complexity and/or positioning of its components such as its dry solid additive source and its prime mover to avoid clumping and/or agglomeration issues that result in formation issues without the addition of a corrective action, which would increase the mechanical complexity of the system. It has been unexpectedly found that an article of manufacture making system comprising a dry solid additive delivery system that minimizes the Stokes Number of the dry solid additives passing through the article of manufacture making system and its dry solid additive delivery system.

In one example of the present invention, an article of manufacture making system that makes an article of manufacture comprising a plurality of dry solid additives, the article of manufacture making system comprising a dry solid additive delivery system comprising one or more dry solid additive inlets and one or more dry solid additive outlets, wherein at least one of the dry solid additive inlets is intimately associated with at least one dry solid additive source that supplies dry solid additives to the at least one dry solid additive inlet wherein the dry solid additives are conveyed through the dry solid additive delivery system from at least one of the dry solid additive inlets to at least one of the dry solid additive outlets from which the dry solid additives are formed into an article of manufacture, for example collected on a collection device to form a fibrous structure, wherein at least one of the dry solid additive outlets is intimately associated with the article of manufacture, wherein one or more prime movers are located between at least one of the dry solid additive inlets and at least one of the dry solid additive outlets, and wherein the Stokes Number of the dry solid additives within the dry solid additive delivery system has a value of less than 2000 in any region of analysis between at least one of the dry solid additive inlets and at least one of the dry solid additive outlets, is provided.

In another example of the present invention, an article of manufacture making system that makes an article of manufacture comprising a plurality of dry solid additives, the article of manufacture making system comprising a dry solid additive delivery system comprising one or more dry solid additive inlets and one or more dry solid additive outlets, wherein at least one of the dry solid additive inlets is intimately associated with at least one dry solid additive source that supplies dry solid additives to the at least one dry solid additive inlet wherein the dry solid additives are conveyed through the dry solid additive delivery system from at least one of the dry solid additive inlets to at least one of the dry solid additive outlets from which the dry solid additives are formed into an article of manufacture, for example collected on a collection device to form a fibrous structure, wherein at least one of the dry solid additive outlets is intimately associated with the article of manufacture, wherein one or more prime movers are located between at least one of the dry solid additive inlets and at least one of the dry solid additive outlets, and wherein the Stokes Number of the dry solid additives within the dry solid additive delivery system has a value of less than 2000 in any region of analysis between at least one of the dry solid additive inlets and at least one of the dry solid additive outlets ignoring the prime movers, is provided.

Accordingly, the present invention provides an article of manufacture making system that makes an article of manufacture that utilizes a dry solid additive delivery system that overcomes the negatives of existing article of manufacture making systems that utilize dry solid additive delivery systems.

DETAILED DESCRIPTION OF THE INVENTION

Definitions

Figure 1A:
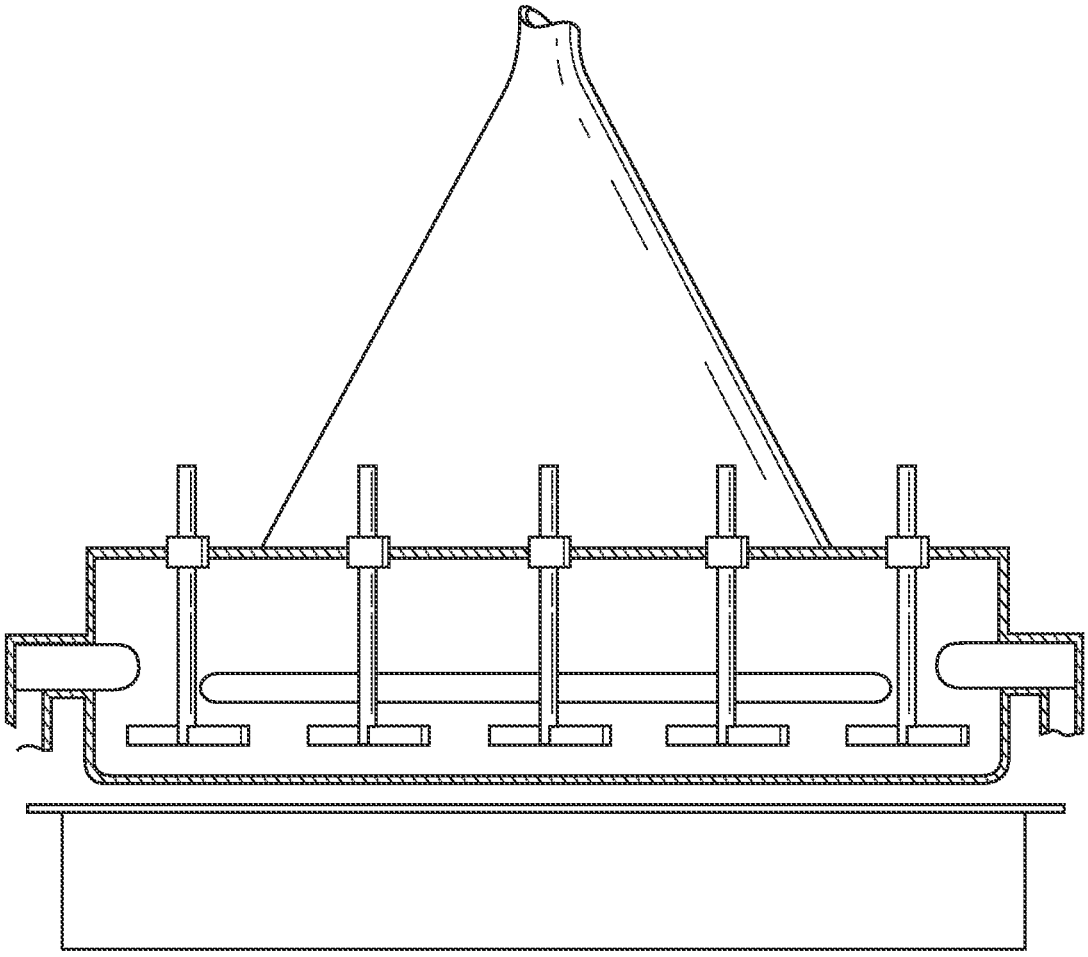
Fig. 1A PRIOR ART
FIG. 1A is an example of a prior art solid additive delivery system.
Figure 1B:
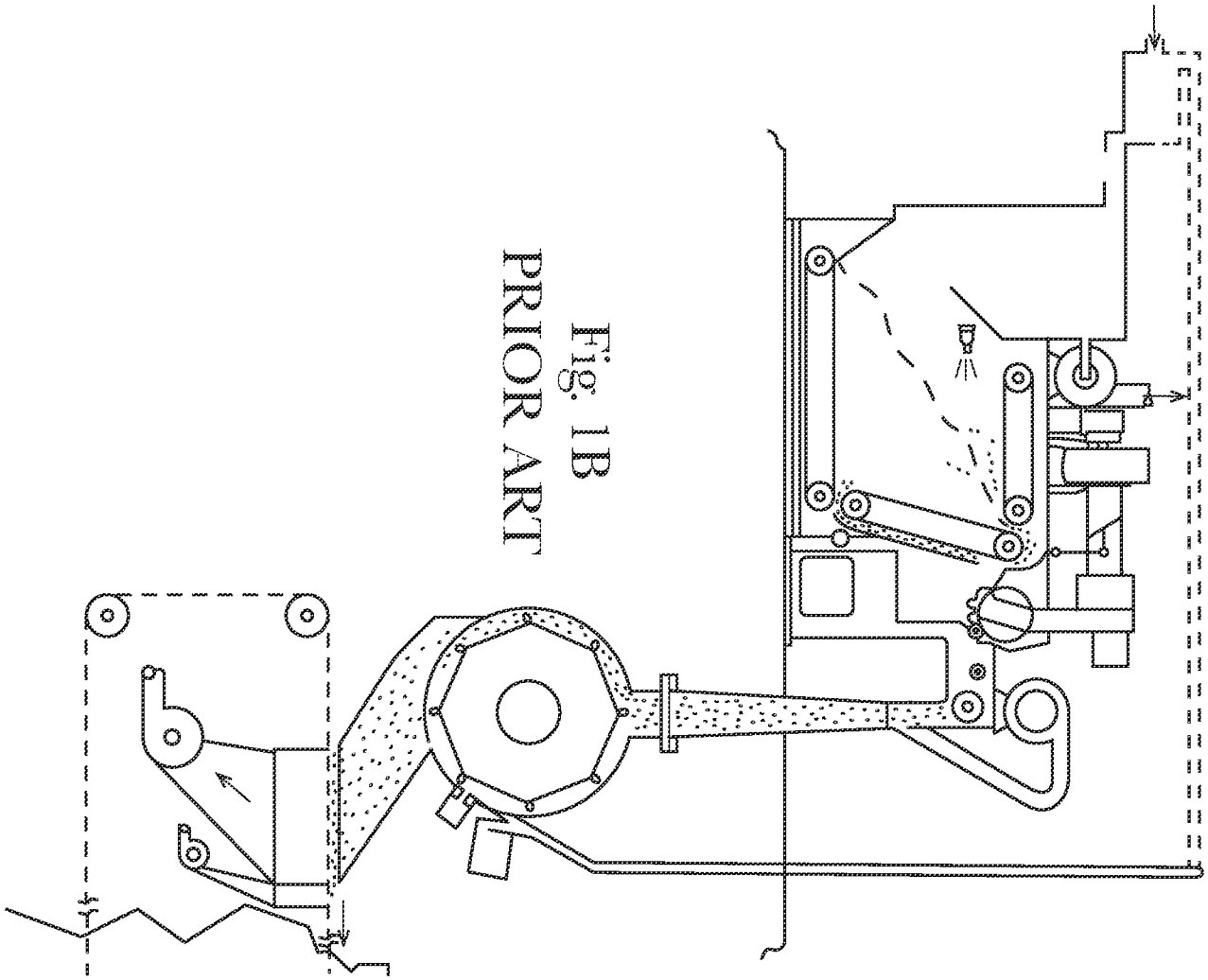
Fig. 1B PRIOR ART
FIG. 1B is another example of a prior art solid additive delivery system.
Figure 1C:
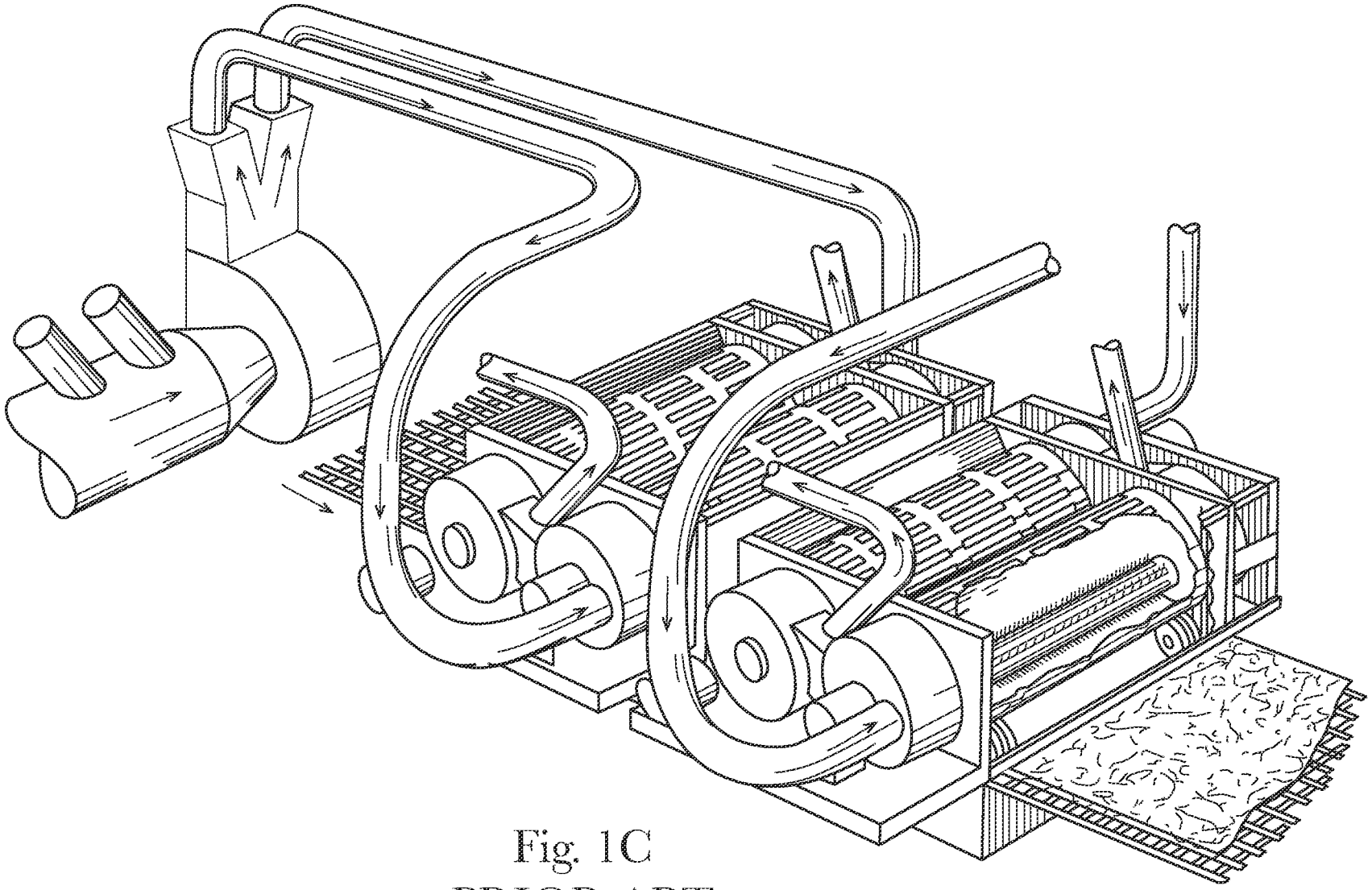
Fig. 1C PRIOR ART
FIG. 1C is another example of a prior art solid additive delivery system.
Figure 1D:
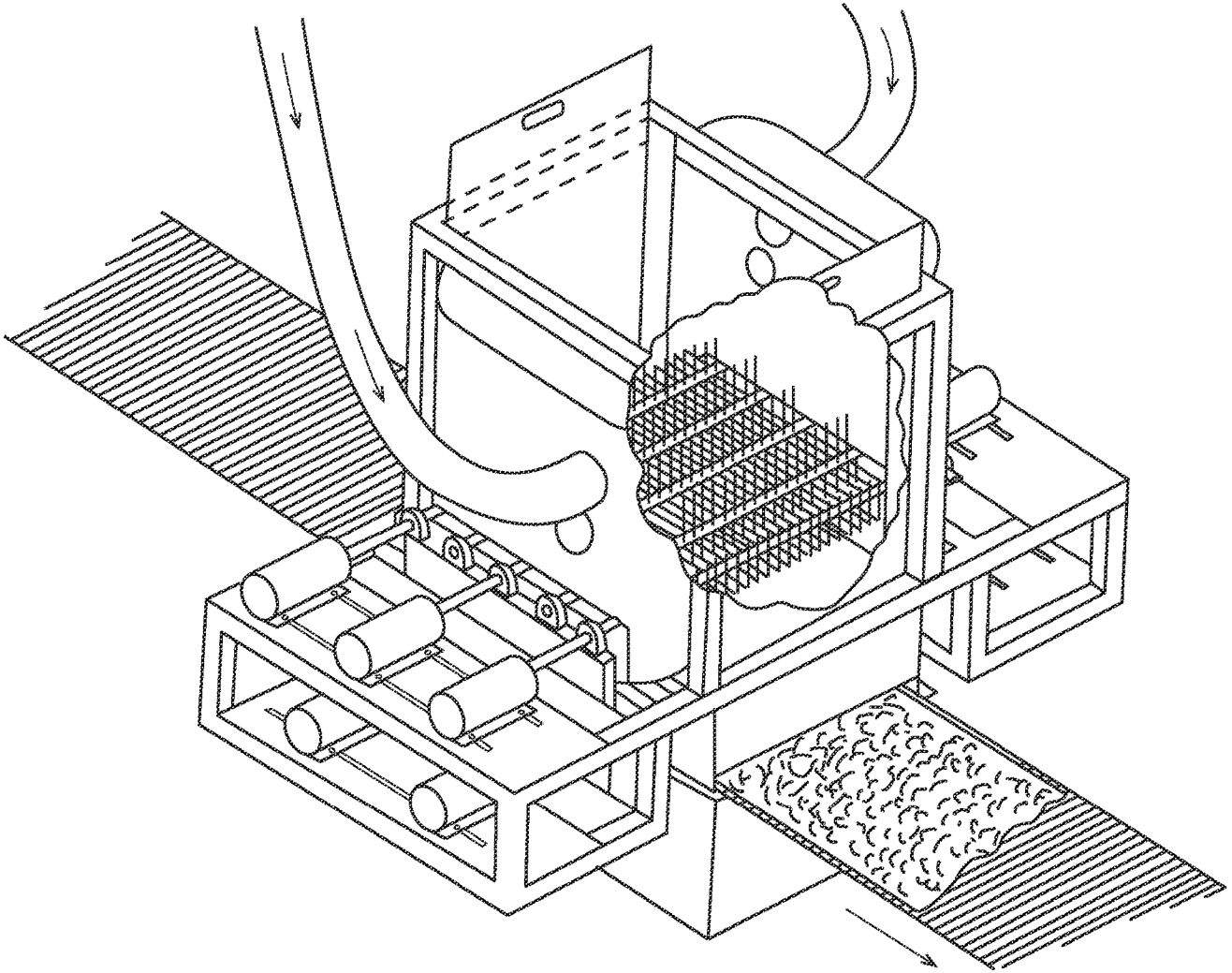
Fig. 1D PRIOR ART
FIG. 1D is another example of a prior art solid additive delivery system.
Figure 1E:
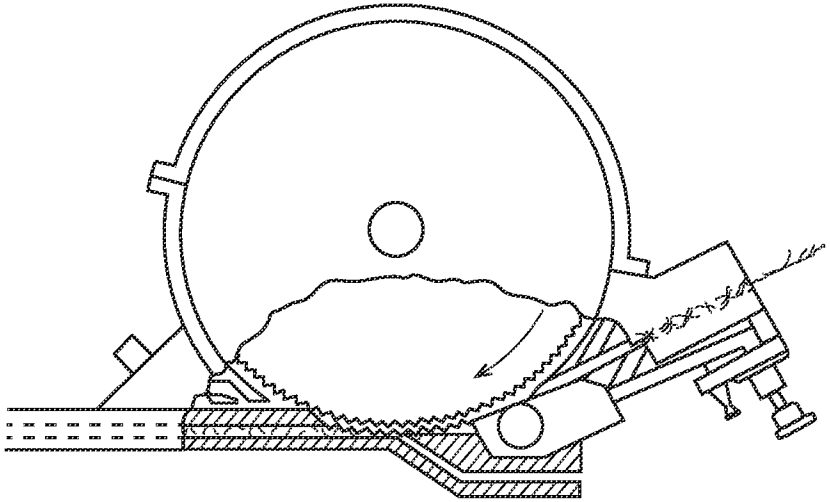
Fig. 1E PRIOR ART
FIG. 1E is another example of a prior art solid additive delivery system.

"Article of manufacture making system" as used herein means a combination of apparatuses that perform functions that when combined together form an article of manufacture, for example a fibrous structure.

"Dry solid additive delivery system" as used herein means an apparatus or multi-apparatus machine that is capable of conveying and delivery dry solid additives within an article of manufacture making process.

"Dry solid additive inlet" as used herein means an entrance, for example an opening defined by a dry solid additive delivery system's housing, into a dry solid additive delivery system through which dry solid additives enter the dry solid additive delivery system.

"Dry solid additive outlet" as used herein means an exit, for example an opening defined by a dry solid additive delivery system's housing, from the dry solid additive delivery system through which dry solid additives exit the dry solid additive delivery system.

"Dry solid additive intermediate outlet" as used herein means any cross-sectional area taken perpendicular to the path and along the path of the dry solid additives within the dry solid additive delivery system between at least one of the dry solid additive inlets and at least one of the dry solid additive outlets.

"Dry solid additive source" as used herein means a component or piece of equipment that supplies dry solid additives to one or more dry solid additive inlets of a dry solid additive delivery system. In one example, a dry solid additive source is a discretizer, for example a hammer mill. The discretizer functions to individualize and/or discretize dry solid additives from a source of dry solid additives, such as a bale of pulp or rolled pulp.

"Intimately associated with" as used herein means that a first component, such as a dry solid additive source, and a second component, such as a dry solid additive inlet, are in direct fluid communication with one another, for example connected directly to one another, without any additional operations or transformations, by piping and/or a duct.

"Prime mover" as used herein means a device that imparts energy into a conveying fluid, such as air. A non-exhaustive list of these devices includes fans, eductors, compressors, blowers, and vacuum pumps. In one example, the prime mover is an eductor, for example a spatially controllable eductor, for example a CD controllable eductor that is capable of being manipulated during operation of the eductor to control pressure, velocity, mass, and/or flow CD profiles of a mixed fluid containing solid additives within the eductor's fluid mixing chamber.

"Aspect ratio" as used herein is measured by first striking a plane either perpendicular to the direction of flow in the case where the flow is primarily unidirectional or parallel with the discharge from the volume in the case where the flow is non-unidirectional. This plane will then define a surface bounded by the walls of the device. With that surface placed on an x-y grid, the lengths of the surface can be determined in these coordinates. The aspect ratio is then defined as the larger length divided by the smaller length.

"Machine direction ("MD") and cross machine-direction ("CD") as used herein can be described using the measured lengths of the plane used to determine aspect ratio. The CD length refers to the longer dimension of the plane; the MD length refers to the smaller axis of the plane.

"Cross flow member" as used herein means an object at least partially contained within an enclosed volume around which flow separates and reconvenes in less than five hydraulic diameters of the object, said hydraulic diameter is calculated on a plane which is perpendicular to the direction of flow and located at the maximum cross sectional area of the object; said area of the member being less than the cumulative area of the void volume in the same plane. In the example of a screen, the solid portions between each individual hole would be a cross flow member. In the example of a pinned roller, each pin as well as the body of the roller would be an example of a cross flow member.

"Hydraulic diameter" as used herein means four times the area of an object divided by the total perimeter of that same object.

"Projected area" as used herein means the two-dimensional area measurement of a three-dimensional object by projecting its shape onto an arbitrary plane, the rectilinear parallel projection of a surface of any shape onto a plane "Region of analysis" as used herein means the volume of fluid dynamic interest for the calculation of Stokes flow. For cross flow members this is the volume around the member. For screens or regions without cross flow members, this is the volume associated with one area of flow. Individual stationary cross flow members less than ¼" and/or surface imperfections are not considered as pertinent for analysis.

"Plane of analysis" as used herein means a two dimensional plane struck parallel to the direction of flow within the region of analysis.

"Screen" as used herein means any object located within a volume which is comprised of a plurality of openings passing entirely through it.

"Unique plane" as used herein means a plane, which for purposes of analysis, contains at least one region of interest different than another plane.

"Stokes Number" or Stk is defined mathematically as $$Stk = \frac{t_p}{t_o}$$

"Particle Time Constant" or $t_p$ is defined mathematically as $$t_p = \frac{\rho_d d_d^2}{18\mu_g}$$

where $\rho_d$ is the particle ("solid additive") density, $d_d$ is the geometric mean of the major and minor particle axes, and $\mu_g$ is the viscosity of the fluid carrying the particle, for example air.

"Fluid Time Constant" or $t_o$ is defined mathematically as $$t_o = \frac{l_o}{v_o}$$

where $l_o$ is the length of interest in a region of analysis and $v_o$ is the bulk velocity in the region of analysis "Length of interest" as used herein means the diameter and/or length and/or width projected on the plane of analysis for cross flow members and/or hydraulic diameters in circular, irregular, or square holed screens or regions without cross flow members.

"Bulk velocity" as used herein means the velocity of the fluid phase relative to the object that contains the length of interest.

"Housing" as used herein means an enclosed or partially-enclosed volume formed by one or more walls wherein a plurality of dry solid additives are conveyed through the volume. The housing comprises at least one dry solid additive inlet, which is intimately associated with at least one dry solid additive source, and at least one dry solid additive outlet, intimately associated with an article of manufacture comprising the dry solid additives. In one example, the housing further comprises at least one prime mover positioned between at least one dry solid additive inlet and at least one dry solid additive outlet. In one example, the housing's at least one dry solid additive outlet opens to a collection device, for example a fabric and/or belt, such as a patterned belt, for receiving the dry solid additives, for example fibers, resulting in a fibrous structure. The receipt by the collection device of the dry solid additives may be aided by a vacuum box.

The housing and/or components and/or equipment used in the article of manufacture making system may be made from any suitable material such as metal, polycarbonate or glass.

"Stream(s) of dry solid additives" as used herein means a plurality of dry solid additives that are moving generally in the same direction. In one example, a stream of dry solid additives is a plurality of dry solid additives, for example fibers, that enter the housing of a dry solid additive delivery system of the present invention through the same dry solid additive inlet at the same time or substantially the same time.

"Fibrous structure" as used herein means a structure that comprises one or more filaments and one or more solid additives, for example fibers. In one example, a fibrous structure according to the present invention means an orderly arrangement of filaments and solid additives within a structure in order to perform a function. Non-limiting examples of fibrous structures of the present invention include paper, fabrics (including woven, knitted, and non-woven), and absorbent pads (for example for diapers or feminine hygiene products).

In one example, the fibrous structure is wound on a roll, for example in a plurality of perforated sheets, and/or cut into discrete sheets.

The fibrous structures of the present invention may be homogeneous or may be layered. If layered, the fibrous structures may comprise at least two and/or at least three and/or at least four and/or at least five layers.

The fibrous structures of the present invention are co-formed fibrous structures.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Solid additive" as used herein means a fiber and/or a particulate.

"Dry solid additive" as used herein means a solid additive that is not in contact with a liquid fluid, for example is in contact, such as is conveyed by and/or is present in a non-liquid fluid environment, such as a gas, for example air.

"Particulate" as used herein means a granular substance, powder and/or particle, such as an absorbent gel material particle.

"Fiber" and/or "Filament" as used herein means an elongate particulate having an apparent length greatly exceeding its apparent width, i.e. a length to diameter ratio of at least about 10. For purposes of the present invention, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include wood pulp fibers and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments. In one example, the polymer filaments of the present invention comprise a thermoplastic polymer, for example a thermoplastic polymer selected from the group consisting of: polyeolefins, such as polypropylene and/or polyethylene, polyesters, polyvinyl alcohol, nylons, polylactic acid, polyhydroxyalkanoate, polycaprolactone, and mixtures thereof. In one example, the thermoplastic polymer comprises a polyolefin, for example polypropylene and/or polyethylene. In another example, the thermoplastic polymer comprises polypropylene.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, lyocell and bagasse can be used in this invention. Other sources of cellulose in the form of fibers or capable of being spun into fibers include grasses and grain sources.

"Sanitary tissue product" as used herein means a soft, low density (i.e. <about 0.15 g/cm3) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 $g/m^2$ to about 120 $g/m^2$ and/or from about 15 $g/m^2$ to about 110 $g/m^2$ and/or from about 20 $g/m^2$ to about 100 $g/m^2$ and/or from about 30 to 90 $g/m^2$. In addition, the sanitary tissue product of the present invention may exhibit a basis weight between about 40 $g/m^2$ to about 120 $g/m^2$ and/or from about 50 $g/m^2$ to about 110 $g/m^2$ and/or from about 55 $g/m^2$ to about 105 $g/m^2$ and/or from about 60 to 100 $g/m^2$.

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present invention may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present invention may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets. In one example, one or more ends of the roll of sanitary tissue product may comprise an adhesive and/or dry strength agent to mitigate the loss of fibers, especially wood pulp fibers from the ends of the roll of sanitary tissue product.

The sanitary tissue products of the present invention may comprises additives such as softening agents, temporary wet strength agents, permanent wet strength agents, bulk softening agents, lotions, silicones, wetting agents, latexes, especially surface-pattern-applied latexes, dry strength agents such as carboxymethylcellulose and starch, and other types of additives suitable for inclusion in and/or on sanitary tissue products.

"Basis Weight" as used herein is the weight per unit area of a sample reported in lbs/3000 ft$^2$ or g/m$^2$.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Article of Manufacture Making System

The article of manufacture making system of the present invention and/or the dry solid additive delivery system used within the article of manufacture making system to deliver dry solid additives to form an article of manufacture are have been designed to exhibit Maximum Stokes Numbers of the dry solid additives passing through the dry solid additive delivery system of less than 2000 and/or less than 1500 and/or less than 1000 and/or less than 750 and/or less than 500 and/or less than 250 and/or less than 125 and/or less than 100 and/or less than 50 and/or about 0 and/or greater than 1.

Table 1 below shows Stokes Numbers of prior art dry solid additive delivery systems compared to Stokes Numbers of dry solid additive delivery systems utilized in the article of manufacture making systems of the present invention (Inventions A-F).

TABLE 1

| Dry Solid Additive Delivery System | Location | Stokes Number |
|---|---|---|
| Prior Art 1 | Pinwheel | 2191 |
| Prior Art 2 | Pinwheel | 2295 |
| Prior Art 3 | Screen | 2176 |
| Prior Art 4 | Screen | 2398 |
| Invention A | After prime mover | 84 |
| Invention B | After prime mover | 122 |
| Invention C | After prime mover | 171 |
| Invention D | Prime Mover | 664 |
| Invention E | Prime Mover | 966 |
| Invention F | Prime Mover | 1352 |

As shown in FIGS. 2-6, the article of manufacture making system 10 of the present invention that makes an article of manufacture 12 comprising a plurality of solid additives 14, comprises a dry solid additive delivery system 16 comprising one or more dry solid additive inlets 18, one or more dry solid additive outlets 20, and one or more dry solid additive intermediate outlets 21. In one example, the dry solid additives 14 are supplied to at least one of the dry solid additive inlets 18 by a dry solid additive source 22.

In one example of the article of manufacture making system of the present invention, the dry solid additive delivery system comprises from 0 to less than about 1000 and/or from 0 to less than 1000 and/or from 0 to less than about 900 and/or from 0 to less than about 800 and/or from 0 to less than about 500 and/or from 0 to less than about 300 and/or from 0 to less than about 100 and/or from 0 to less than about 50 cross flow members between at least one of the dry solid additive sources and at least one of the dry solid additive outlets and/or between at least one of the dry solid additive inlets and at least one of the dry solid additive intermediate outlets.

In another example of the article of manufacture making system of the present invention, the dry solid additive delivery system comprises at least one dry solid additive inlet, at least one dry solid additive source, and at least one dry solid additive intermediate outlet that exhibit an aspect ratio of greater than 1 and wherein at least one of the dry solid additive intermediate outlets exhibits a CD dimension that is greater than the CD dimension of at least one of the dry solid additive inlets and at least one of the dry solid additive sources.

In yet another example of the article of manufacture making system of the present invention, the dry solid additive delivery system comprises at least one dry solid additive inlet, at least one dry solid additive source, and at least one dry solid additive intermediate outlet that exhibit an aspect ratio of greater than 1 and wherein the number of dry solid additive intermediate outlets is greater than the number of dry solid additive sources.

In even yet another example of the article of manufacture making system of the present invention, the dry solid additive delivery system comprises one or more prime movers located between at least one of the dry solid additive inlets and at least one of the dry solid additive intermediate outlets, wherein at least one of the dry solid additive sources, at least one of the prime movers, and at least one of the dry solid additive intermediate outlets exhibits an aspect ratio of greater than 1.

Figure 2:
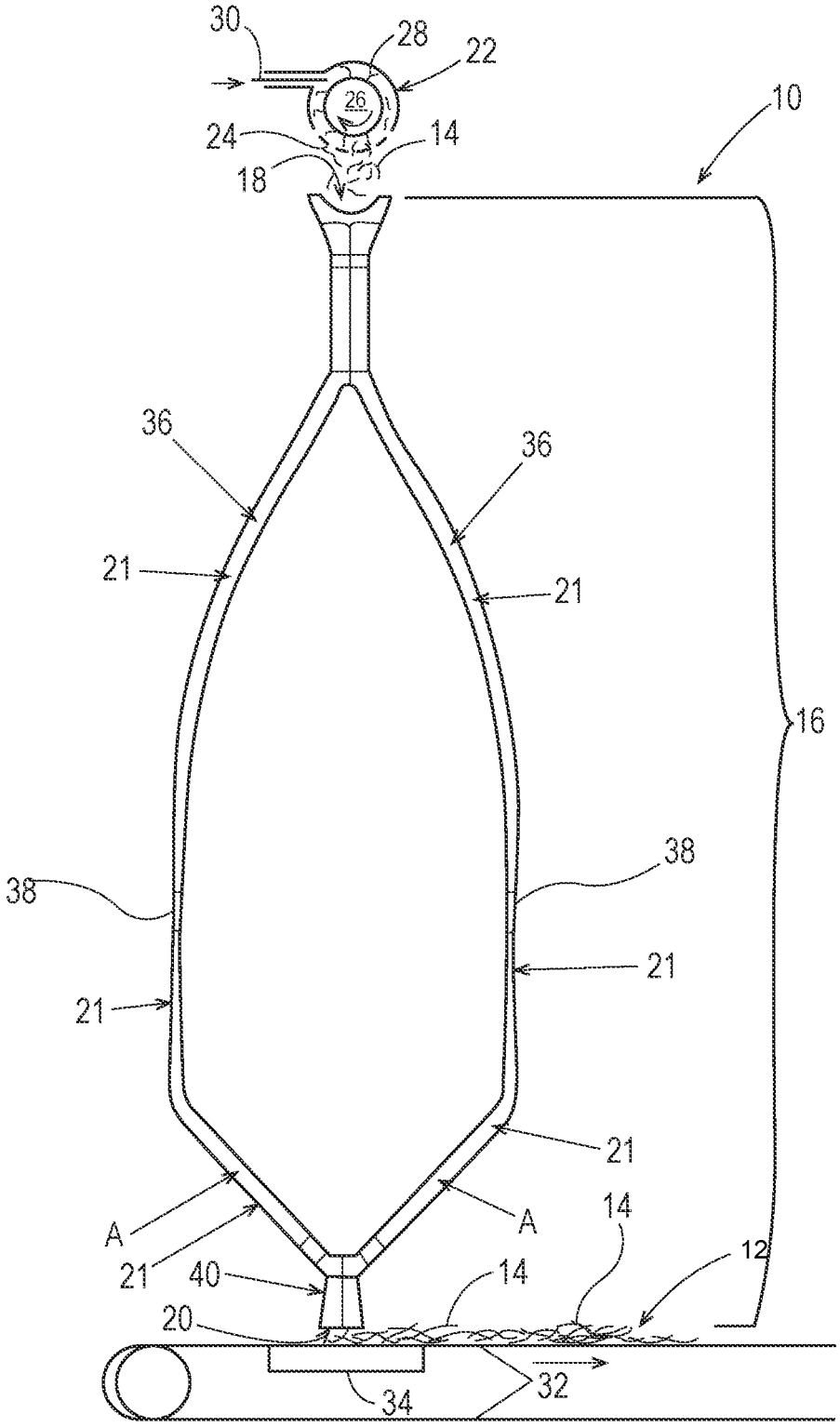
FIG. 2 is an example of an article of manufacture making system that utilizes a dry solid additive delivery system.

In one example, as shown in FIG. 2, the article of manufacture making system 10 of the present invention that makes an article of manufacture 12 comprising a plurality of solid additives 14, comprises a dry solid additive delivery system 16 comprising one dry solid additive inlet 18, one dry solid additive outlet 20, and one or more dry solid additive intermediate outlets 21. The dry solid additive inlet 18 is intimately associated with a dry solid additive source 22. The dry solid additive source 22 supplies dry solid additives 14 to the dry solid additive inlet 18. The dry solid additive source 22, in this case, comprises a screen 24 through which the dry solid additives 14 pass to enter the dry solid additive inlet 18. For clarity purposes, the dry solid additive source 22 is shown exploded from the dry solid additive inlet 18, however, in practice, the dry solid additive source 22 in FIG. 2 is received by and sits upon the dry solid additive inlet 18. The dry solid additive source 22 further comprises a rotor 26 that comprises swinging hammers 28. The rotor 26 rotates, in this case, in a clockwise rotation as shown by the arrow to permit the swinging hammers 28 to individualize the dry solid additives 14 from a source of dry solid additives 30, such as a bale of pulp or rolled pulp, that enters the dry solid additive source 22 as shown by its corresponding arrow.

Once the dry solid additives 14 enter the dry solid additive delivery system 16 through the dry solid additive inlet 18, the dry solid additives 14 are conveyed through the dry solid additive delivery system 16 from the dry solid additive inlet 18 to the dry solid additive outlet 20 from which the dry solid additives 14 are formed into an article of manufacture 12, for example a fibrous structure by being collected onto a collection device 32, such as a fabric or belt, for example a patterned belt, with or without the aid of a vacuum box 34. The dry solid additive outlet 20 is intimately associated with the article of manufacture 12.

Along the dry solid additives path 36, in this case paths 36, the dry solid additives 14 may be influenced by one or more prime movers 38, such as an eductor, for example spatially controllable eductor, such as a CD controllable eductor, or a fan, that are located between the dry solid additive inlet 18 and the dry solid additive outlet 20. The prime mover 38, when present, may be positioned anywhere between the dry solid additive inlet 18 and the dry solid additive outlet 20, such as in a position where there are no more bends in the path 36, for example at position A. In addition to the prime movers, one or more dry solid additive intermediate outlets 21 may be located anywhere between the dry solid additive inlet 18 and the dry solid additive outlet 20 when a prime mover 38 isn't present. If a prime mover 38 is present that the dry solid additive intermediate outlets 21 need to be located between at least one of the dry solid additive inlets 18 and the prime mover 38.

In addition to prime mover's 38 being present, a forming box 40, which functions to bring two or more materials together, such as two different paths 36 of dry solid additives 14 to mix the dry solid additives 14 together before they exit the dry solid additive outlet 20 to form the article of manufacture 12. In one example, the forming box 40 is a coform box, which is intimately associated along the path(s) 36 of the dry solid additives 14 immediately adjacent to the dry solid additive outlet 20, designed to mix filaments, such as meltblown filaments from a meltblow die and/or spunbond filaments from a spunbond die, together with the dry solid additives 14 to form a coform fibrous structure upon exit the dry solid additive outlet 20.

Further, one or more dry solid additive intermediate outlets 21 may be located between the dry solid additive inlet 18 and the dry solid additive outlet 20.

Figure 3:
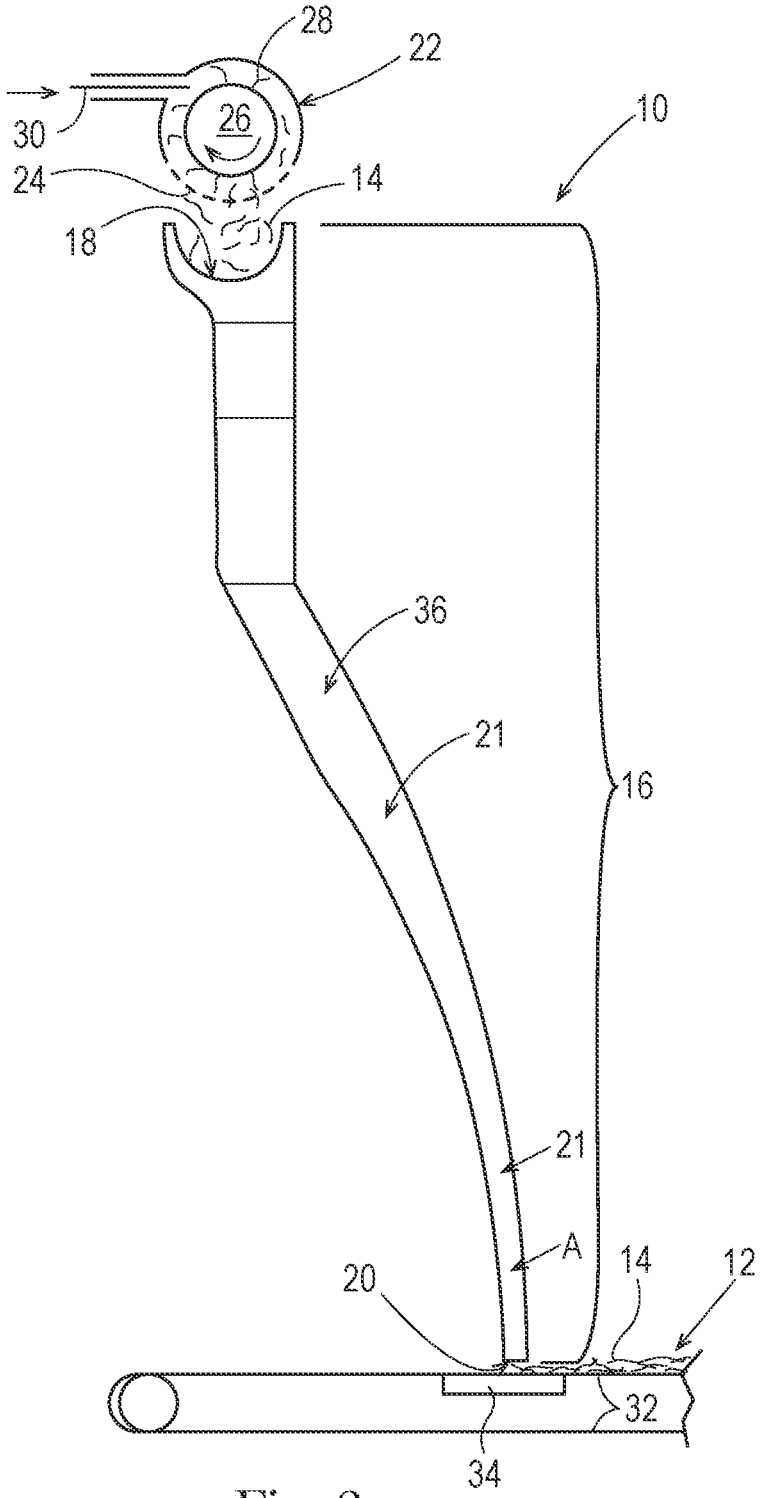
FIG. 3 is another example of an article of manufacture making system the utilizes a dry solid additive delivery system.

In another example, as shown in FIG. 3, the article of manufacture making system 10 of the present invention that makes an article of manufacture 12 comprising a plurality of solid additives 14, comprises a dry solid additive delivery system 16 comprising one dry solid additive inlet 18, one or more dry solid additive outlet 20, and one or more dry solid additive intermediate outlets 21. The dry solid additive inlet 18 is intimately associated with a dry solid additive source 22. The dry solid additive source 22 supplies dry solid additives 14 to the dry solid additive inlet 18. The dry solid additive source 22, in this case, comprises a screen 24 through which the dry solid additives 14 pass to enter the dry solid additive inlet 18. For clarity purposes, the dry solid additive source 22 is shown exploded from the dry solid additive inlet 18, however, in practice, the dry solid additive source 22 in FIG. 3 is received by and sits upon the dry solid additive inlet 18. The dry solid additive source 22 further comprises a rotor 26 that comprises swinging hammers 28. The rotor 26 rotates, in this case, in a clockwise rotation as shown by the arrow to permit the swinging hammers 28 to individualize the dry solid additives 14 from a source of dry solid additives 30, such as a bale of pulp or rolled pulp, that enters the dry solid additive source 22 as shown by its corresponding arrow.

Once the dry solid additives 14 enter the dry solid additive delivery system 16 through the dry solid additive inlet 18, the dry solid additives 14 are conveyed through the dry solid additive delivery system 16 from the dry solid additive inlet 18 to the dry solid additive outlet 20 from which the dry solid additives 14 are formed into an article of manufacture 12, for example a fibrous structure by being collected onto a collection device 32, such as a fabric or belt, for example a patterned belt, with or without the aid of a vacuum box 34.

The dry solid additive outlet 20 is intimately associated with the article of manufacture 12.

Along the dry solid additives path 36, the dry solid additives 14 may be influenced by one or more prime movers (not shown), such as an eductor, for example a CD controllable eductor, or a fan, that are located between the dry solid additive inlet 18 and the dry solid additive outlet 20. The prime mover, when present, may be positioned anywhere between the dry solid additive inlet 18 and the dry solid additive outlet 20, such as in a position where there are no more bends in the path 36, for example at position A. In addition to the prime movers, one or more forming boxes (not shown), such as a coform box, may be intimately associated with and located immediately adjacent to the dry solid additive outlet 20. In addition to the prime movers and the forming boxes, one or more dry solid additive intermediate outlets 21 may be located between the dry solid additive inlet 18 and the dry solid additive outlet 20.

Figure 4:
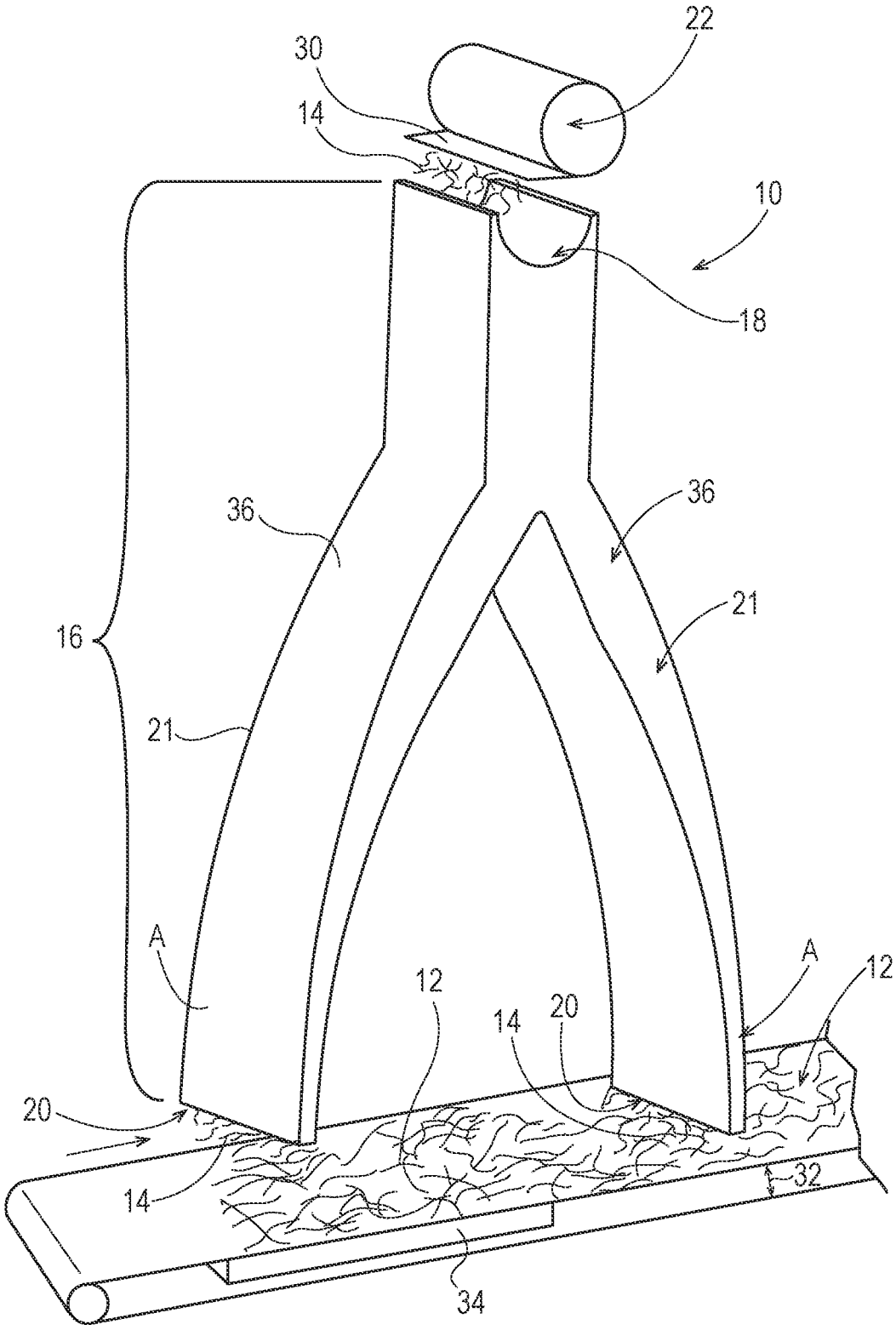
FIG. 4 is another example of an article of manufacture making system the utilizes a dry solid additive delivery system.
Figure 5:
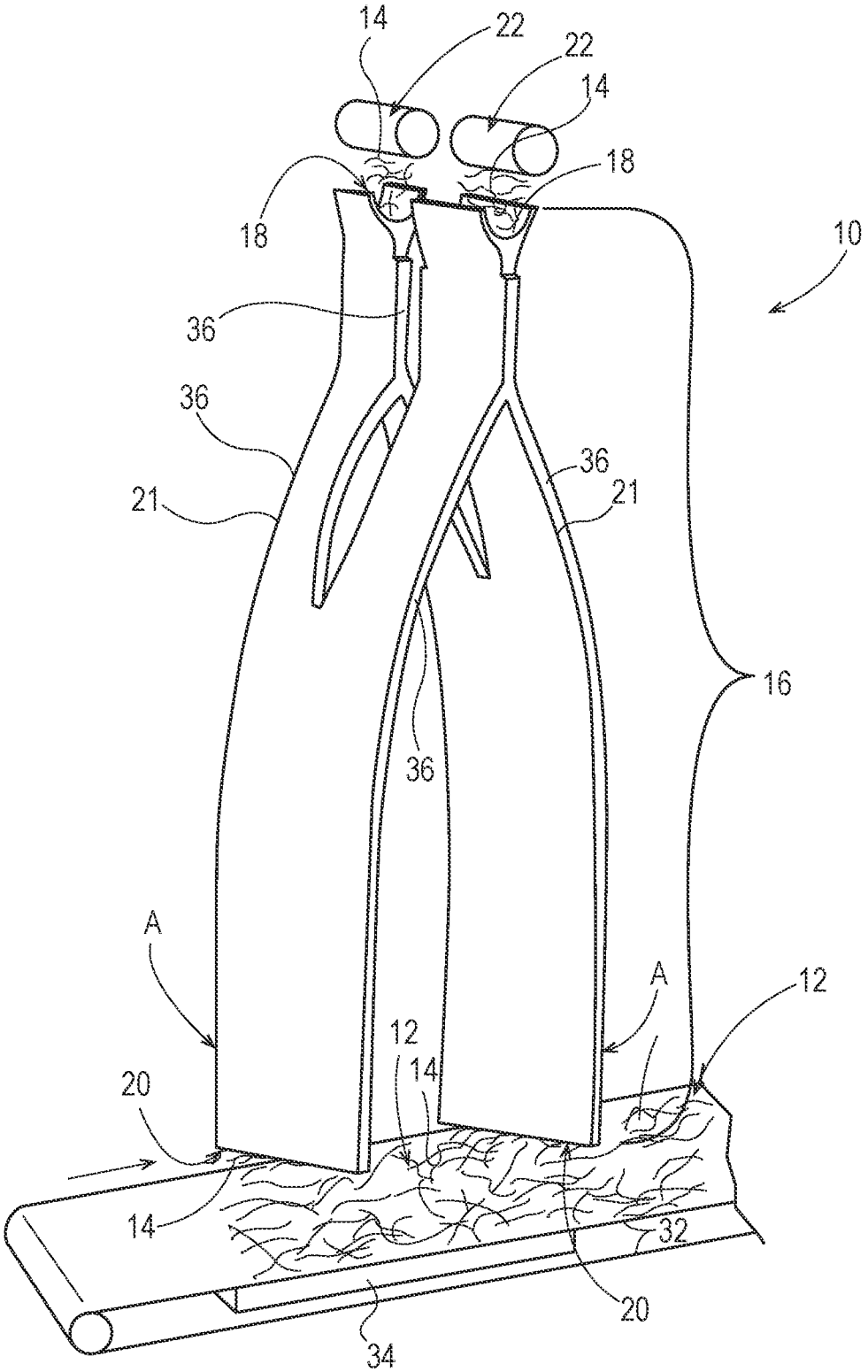
FIG. 5 is another example of an article of manufacture making system the utilizes a dry solid additive delivery system.

In another example, as shown in FIG. 4, the article of manufacture making system 10 of the present invention that makes an article of manufacture 12 comprising a plurality of solid additives 14, comprises a dry solid additive delivery system 16 comprising one dry solid additive inlet 18, one or more dry solid additive outlet 20, and one or more dry solid additive intermediate outlets 21. The dry solid additive inlet 18 is intimately associated with a dry solid additive source 22, which is shown in detail in FIGS. 2 and 3. The dry solid additive source 22 supplies dry solid additives 14 to the dry solid additive inlet 18. The dry solid additive source 22 comprises a screen 24 through which the dry solid additives 14 pass to enter the dry solid additive inlet 18. For clarity purposes, the dry solid additive source 22 is shown exploded from the dry solid additive inlet 18, however, in practice, the dry solid additive source 22 in FIG. 4 is received by and sits upon the dry solid additive inlet 18. The dry solid additive source 22 further comprises a rotor 26 that comprises swinging hammers 28. The rotor 26 rotates, in this case, in a clockwise rotation as shown by the arrow to permit the swinging hammers 28 to individualize the dry solid additives 14 from a source of dry solid additives 30, such as a bale of pulp or rolled pulp, that enters the dry solid additive source 22 as shown by its corresponding arrow.

Once the dry solid additives 14 enter the dry solid additive delivery system 16 through the dry solid additive inlet 18, the dry solid additives 14 are conveyed through the dry solid additive delivery system 16 from the dry solid additive inlet 18 to the dry solid additive outlet 20 from which the dry solid additives 14 are formed into an article of manufacture 12, for example a fibrous structure by being collected onto a collection device 32, such as a fabric or belt, for example a patterned belt, with or without the aid of a vacuum box 34. The dry solid additive outlet 20 is intimately associated with the article of manufacture 12.

Along the dry solid additives path 36, the dry solid additives 14 may be influenced by one or more prime movers (not shown), such as an eductor, for example a CD controllable eductor, or a fan, that are located between the dry solid additive inlet 18 and the dry solid additive outlet 20. The prime mover, when present, may be positioned anywhere between the dry solid additive inlet 18 and the dry solid additive outlet 20, such as in a position where there are no more bends in the path 36, for example at position A. In addition to the prime movers, one or more forming boxes (not shown), such as a coform box, may be intimately associated with and located immediately adjacent to the dry solid additive outlet 20. In addition to the prime movers and the forming boxes, one or more dry solid additive intermediate outlets 21 may be located between the dry solid additive inlet 18 and the dry solid additive outlet 20.

Figure 6:
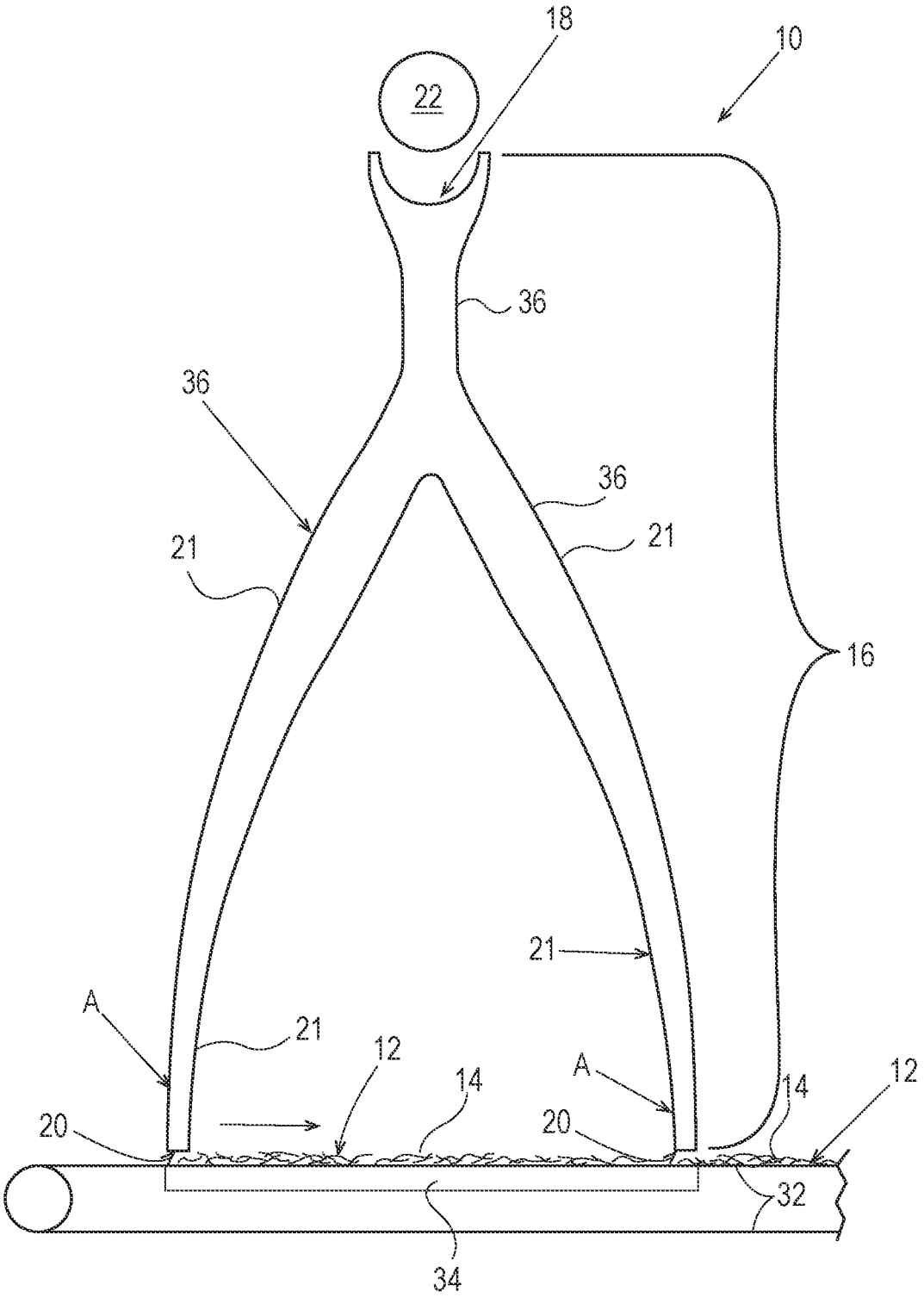
FIG. 6 is another example of an article of manufacture making system the utilizes a dry solid additive delivery system.

In even another example, as shown in FIG. 6, the article of manufacture making system 10 of the present invention that makes an article of manufacture 12 comprising a plurality of solid additives 14, comprises a dry solid additive delivery system 16 comprising a dry solid additive inlet 18, two dry solid additive outlets 20, and one or more dry solid additive intermediate outlets 21. The dry solid additive inlet 18 is intimately associated with a dry solid additive source 22, which is shown in detail in FIGS. 2 and 3. The dry solid additive source 22 supplies dry solid additives 14 to the dry solid additive inlet 18. The dry solid additive source 22, in this case, comprise a screen 24 through which the dry solid additives 14 pass to enter the dry solid additive inlet 18. For clarity purposes, the dry solid additive source 22 is shown exploded from the dry solid additive inlet 18, however, in practice, the dry solid additive source 22 in FIG. 6 is received by and sits upon the dry solid additive inlet 18. The dry solid additive source 22 further comprises a rotor 26 that comprises swinging hammers 28. The rotor 26 rotates, in this case, in a clockwise rotation as shown by the arrow to permit the swinging hammers 28 to individualize the dry solid additives 14 from a source of dry solid additives 30, such as a bale of pulp or rolled pulp, that enters the dry solid additive source 22 as shown by its corresponding arrow.

Once the dry solid additives 14 enter the dry solid additive delivery system 16 through the dry solid additive inlet 18, the dry solid additives 14 are conveyed through the dry solid additive delivery system 16 from the dry solid additive inlet 18 to the dry solid additive outlet 20 from which the dry solid additives 14 are formed into an article of manufacture 12, for example a fibrous structure by being collected onto a collection device 32, such as a fabric or belt, for example a patterned belt, with or without the aid of a vacuum box 34. The dry solid additive outlet 20 is intimately associated with the article of manufacture 12.

Along the dry solid additives path 36, the dry solid additives 14 may be influenced by one or more prime movers (not shown), such as an eductor, for example a CD controllable eductor, or a fan, that are located between the dry solid additive inlet 18 and the dry solid additive outlet 20. The prime mover, when present, may be positioned anywhere between the dry solid additive inlet 18 and the dry solid additive outlet 20, such as in a position where there are no more bends in the path 36, for example at position A. In addition to the prime movers, one or more forming boxes (not shown), such as a coform box, may be intimately associated with and located immediately adjacent to the dry solid additive outlet 20. In addition to the prime movers and the forming boxes, one or more dry solid additive intermediate outlets 21 may be located between the dry solid additive inlet 18 and the dry solid additive outlet 20.

The dry solid additive sources of the present invention may be a discretizer. The discretizer may be a hammer mill.

In one example, the dry solid additive system comprises a plurality of dry solid additive inlets. At least one of the dry solid additive inlets is supplied with dry solid additives by a dry solid additive source that is a discretizer, for example a hammer mill. In another example, at least one of the dry solid additive inlets is supplied with dry solid additives by a web feed system. In still another example, at least one of the dry solid additive inlets is supplied with dry solid additives by a liquid injector. In even still another example, at least one of the dry solid additive inlets is supplied with dry solid additives by a particle injector.

In one example, the dry solid additive delivery system comprises at least one prime mover that is an eductor.

In another example, the article of manufacture making system of the present invention comprises two or more dry solid additive sources and a dry solid additive delivery system comprising one or more prime movers such that the number of dry solid additive sources is greater than the number of prime movers within the article of manufacture making system. In another example, the article of manufacture making system of the present invention comprises one or more dry solid additive sources and a dry solid additive delivery system comprising two or more prime movers such that the number of prime movers is greater than the number of dry solid additive sources in the article of manufacture making system.

In one example, the dry solid additive delivery system of the present invention comprises at least one dry solid additive outlet that exhibits a CD dimension that is greater than the CD dimension of at least one of the dry solid additive inlets. In addition to this, the article of manufacture making system that incorporates the dry solid additive delivery system comprises at least one prime mover that is an eductor.

In another example, the dry solid additive delivery system of the present invention comprises at least one prime mover, such as an eductor, wherein the CD dimension of the at least one prime mover's outlet (discharge area) is greater than the CD dimension of at least one of the dry solid additive inlets. In addition to this, the article of manufacture making system that incorporates the dry solid additive delivery system comprises two or more dry solid additive outlets and one or more dry solid additive sources such that the number of dry solid additive outlets is greater than the number of dry solid additive sources in the article of manufacture making system. In addition to this, the article of manufacture making system that incorporates the dry solid additive delivery system comprises at least one prime mover that is an eductor.

In one example, the article of manufacture making system makes an article of manufacture by collecting a plurality of solid additives from at least one of the dry solid additive outlets onto a collection device, such as a fabric or belt. In one example, the CD dimension of the collection device is greater than the CD dimension of at least one of the dry solid additive inlets.

In one example, the article of manufacture making system comprises a greater number of dry solid additive outlets than the number of dry solid additive sources in the article of manufacture making system. In another example, the article of manufacture making system comprises a greater number of dry solid additive intermediate outlets than the number of dry solid additive sources in the article of manufacture making system.

It has been unexpectedly found that making articles of manufacture using the article of manufacture making system of the present invention, reduces and/or eliminates the issues with mechanical complexity, tendency to create contamination, low throughput, and/or quality formation of the article of manufacture.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An article of manufacture making system that makes an article of manufacture comprising a plurality of dry solid additives selected from the group consisting of fibers, particulates, and mixtures thereof, the article of manufacture making system comprising a dry solid additive delivery system comprising one or more dry solid additive inlets and one or more dry solid additive outlets, wherein at least one of the dry solid additive inlets is intimately associated with at least one dry solid additive source comprising a discretizer comprising a screen that supplies dry solid additives to the at least one dry solid additive inlet wherein the dry solid additives are conveyed through the dry solid additive delivery system from at least one of the dry solid additive inlets to at least one of the dry solid additive outlets from which the dry solid additives are formed into an article of manufacture, wherein at least one of the dry solid additive outlets is intimately associated with the article of manufacture, wherein the article of manufacture making system further comprises one or more prime movers that exhibits an aspect ratio of greater than 1, and wherein the Stokes Number of the dry solid additives within the dry solid additive delivery system has a value of less than 2000 in any region of analysis between at least one of the dry solid additive inlets and at least one of the dry solid additive outlets.

2. The article of manufacture making system according to claim 1 wherein the Stokes Number of the dry solid additives within the dry solid additive delivery system has a value of less than 1500 in any region of analysis between at least one of the dry solid additive inlets and at least one of the dry solid additive outlets.

3. The article of manufacture making system according to claim 1 wherein the dry solid additive delivery system comprises a plurality of dry solid additive inlets.

4. The article of manufacture making system according to claim 1 wherein at least one of the prime movers is an eductor.

5. The article of manufacture making system according to claim 1 wherein the number of dry solid additive sources is greater than the number of prime movers in the article of manufacture making system.

6. The article of manufacture making system according to claim 1 wherein the number of prime movers is greater than the number of dry solid additive sources in the article of manufacture making system.

7. The article of manufacture making system according to claim 1 wherein the dry solid additive delivery system comprises from 0 to less than about 1000 cross flow members between at least one of the dry solid additive inlets and one of the dry solid additive outlets.

8. The article of manufacture making system according to claim 1 wherein at least one of the dry solid additive outlets exhibits a cross machine direction (CD) dimension that is greater than at least one of the dry solid additive inlets' CD dimension.

9. The article of manufacture making system according to claim 1 wherein the number of dry solid additive outlets is greater than the number of dry solid additive sources in the article of manufacture making system.

10. An article of manufacture making system that makes an article of manufacture comprising a plurality of dry solid additives selected from the group consisting of fibers, particulates, and mixtures thereof, the article of manufacture making system comprising a dry solid additive delivery system comprising one or more dry solid additive inlets and one or more dry solid additive outlets, wherein at least one of the dry solid additive inlets is intimately associated with at least one dry solid additive source comprising a discretizer comprising a screen that supplies dry solid additives to the at least one dry solid additive inlet wherein the dry solid additives are conveyed through the dry solid additive delivery system from at least one of the dry solid additive inlets to at least one of the dry solid additive outlets from which the dry solid additives are formed into an article of manufacture, wherein at least one of the dry solid additive outlets is intimately associated with the article of manufacture, wherein the article of manufacture making system further comprises one or more prime movers that exhibits an aspect ratio of greater than 1, and wherein the Stokes Number of the dry solid additives within the dry solid additive delivery system has a value of less than 2000 in any region of analysis between at least one of the dry solid additive inlets and at least one of the dry solid additive outlets ignoring the prime movers.

11. The article of manufacture making system according to claim 10 wherein the Stokes Number of the dry solid additives within the dry solid additive delivery system has a value of less than 1500 in any region of analysis between at least one of the dry solid additive inlets and at least one of the dry solid additive outlets.

12. The article of manufacture making system according to claim 10 wherein the dry solid additive delivery system comprises a plurality of dry solid additive inlets.

13. The article of manufacture making system according to claim 10 wherein at least one of the prime movers is an eductor.

14. The article of manufacture making system according to claim 10 wherein the number of dry solid additive sources is greater than the number of prime movers in the article of manufacture making system.

15. The article of manufacture making system according to claim 10 wherein the number of prime movers is greater than the number of dry solid additive sources in the article of manufacture making system.

16. The article of manufacture making system according to claim 10 wherein the dry solid additive delivery system comprises from 0 to less than 1000 cross flow members between at least one of the dry solid additive inlets and one of the dry solid additive outlets.

17. The article of manufacture making system according to claim 10 wherein at least one of the dry solid additive outlets exhibits a cross machine direction (CD) dimension that is greater than at least one of the dry solid additive inlets' CD dimension.

18. The article of manufacture making system according to claim 10 wherein the number of dry solid additive outlets is greater than the number of dry solid additive sources in the article of manufacture making system.

* * * * *